United States Patent [19]

Pelonis

[11] Patent Number: 4,703,153

[45] Date of Patent: Oct. 27, 1987

[54] ELECTRIC HEATER EMPLOYING SEMICONDUCTOR HEATING ELEMENTS

[75] Inventor: Kosta Pelonis, Bradford, Canada

[73] Assignee: Pelko Electric Inc., Weston, Canada

[21] Appl. No.: 747,863

[22] Filed: Jun. 24, 1985

[51] Int. Cl.[4] ..... H05B 1/02; H05B 3/06; F24H 3/04

[52] U.S. Cl. ..... 219/370; 219/368; 219/374; 219/376; 219/382; 219/505; 219/532; 219/541; 338/22 R

[58] Field of Search ..... 219/363–368, 219/369–376, 381, 382, 504, 505, 530, 540, 541, 532, 206–207; 338/22 R; 123/549, 557

[56] References Cited

U.S. PATENT DOCUMENTS

| | | | |
|---|---|---|---|
| 2,391,964 | 1/1946 | Green | 219/370 |
| 4,032,752 | 6/1977 | Ohmura et al. | 219/541 |
| 4,108,125 | 8/1978 | Marcoux et al. | 219/207 X |
| 4,141,327 | 2/1979 | Marcoux et al. | 219/381 X |
| 4,450,823 | 5/1984 | Abe et al. | 219/207 X |

FOREIGN PATENT DOCUMENTS

| | | | |
|---|---|---|---|
| 1190579 | 7/1985 | Canada . | |
| 33160 | 3/1977 | Japan | 219/376 |
| 52-755 | 4/1977 | Japan | 219/381 |
| 2524 | 1/1979 | Japan | 219/375 |
| 139140 | 10/1979 | Japan | 219/505 |
| 12950 | 2/1981 | Japan | 219/375 |
| 1081422 | 8/1967 | United Kingdom | 219/374 |

*Primary Examiner*—Anthony Bartis

[57] ABSTRACT

An electric heater employs plate-shaped heating elements, each consisting of a core of semiconductor material whose opposing faces are coated with conductive material and having a multiplicity of apertures to permit passage of air. The heater includes a housing with a rear air inlet and a forward air outlet. A fan having a fan venturi causes air flows forwardly through the housing. A two-piece, ceramic holder maintains a number of the plate-shaped heating elements in generally coplanar, spaced-apart relationship, in front of a forward venturi opening. The holder has a large recess positioned over the forward venturi opening which receives substantially all air flow from the venturi, and a number of passages, one associated with each heating element, which direct air from the recess through the cores towards the forward air outlet. Each of the passages flares radially outwardly and rearwardly from the rear face of the associated heating element, and opens into the recess and the recess flares radially outwardly and rearwardly from about the passage openings to the forward venturi opening. The arrangement results in improved heat transfer and much quieter operation than would otherwise be achieved. To accommodate thermal expansion and contraction of the heating elements, the two pieces of the holder are clamped together by spring-loaded bolts which permit the spacing between the holder members to vary, while still securing the heating elements.

18 Claims, 5 Drawing Figures

ELECTRIC HEATER EMPLOYING SEMICONDUCTOR HEATING ELEMENTS

FIELD OF THE INVENTION

The invention relates to forced-air electric heaters, and more particularly to improvements in the construction of electric heaters incorporating semiconductor heating elements.

BACKGROUND OF THE INVENTION

Electric heaters employing semiconductor heating elements represent a marked improvement over prior resistance-wire type heaters. These new heaters include heating elements which consists of a planar core of semiconductor material formed with a multiplicity of apertures that permit passage of air to draw heat from the core. Opposing faces of the core are coated with electrically conductive coatings that produce a fairly even distribution of current flow in the core when a voltage difference is applied to the coatings. These heaters tend to be more durable than prior resistance-wire type heaters, tend to be more compact for a given heat requirement, and have the additional advantage that very hot air flows can be produced while the temperature of the associated heating element remains below about 200 degrees centigrade, thereby reducing the risk of fire, particularly where there are flammable materials in the heated environment. Such a heater was proposed by me in my Canadian Pat. No. 1,119,579.

Heaters incorporating semiconductor heating elements of the type described above are still relatively novel, and a number of problems have arisen in the construction of such heaters. In particular, a convenient, inexpensive mechanism is required to hold the heating elements. The exact manner in which the heating elements are held tends to be more critical in the new type heaters than in the old resistance-wire type, as the heating elements tend to be smaller, and air flows from an associated fan must consequently be more tightly constrained to achieve the full benefit of employing such heating elements. As well, because of the size and nature of the heating elements, considerable care must be taken to ensure simultaneous electrical and thermal isolation of the heating elements from any associated housing, and proper electrical contact with a supply of line voltage. Moreover, it is desirable to improve the heat transfer efficiency of such a heater, and to provide quieter operation, operation tending to be noisy because of the extent to which air flows are affected by the limited cross-sectional area of the new heating elements.

Accordingly, it is one object of the present invention to provide a heater construction employing semiconductor heating elements of the type described above which results in improved heat transfer and quiet operation.

It is another object of the invention to provide a convenient, inexpensive mechanism for holding and electrically contacting semiconductor heating elements of the type described above.

BRIEF SUMMARY OF THE INVENTION

The invention provides an electric heater which includes a housing having a rear air inlet and a forward air outlet. A fan is mounted inside the housing intermediate of the rear air inlet and the forward air inlet to produce an air flow through the housing. The fan is of a type which includes a fan venturi that directs air flow generated by the fan from a rear venturi opening (which is placed in communication with the rear air inlet of the housing) to a forward venturi opening.

The fan air flows are heated by a multiplicity of disk-shaped heating elements. Each heating element includes a generally planar core with a pair of opposing forward and rear core faces, electrically conductive coatings covering each of the opposing faces, and a multiplicity of apertures which permit air flow through the core. The cores are formed of a semiconductor material with preferrably a positive resistance-temperature coefficient (PTC), the significance of which will be discussed below in connection with a preferred embodiment of the invention.

A heating element holder formed of an electrically insulating and heat-insulating material is mounted in the housing intermediate of the forward fan venturi opening and the forward air outlet of the housing. The holder includes holding means which maintain the heating elements in generally coplanar, spaced-apart relationship relative to one another. When the holder is in an operative position, the heating elements are oriented generally perpendicular to the longitudinal axis of the fan venturi and spaced forwardly therefrom, with each rear core face facing toward the forward venturi opening.

The holder is adapted to direct air flows escaping from the forward fan venturi opening through the cores. Accordingly, the holder comprises air flow receiving means, including a recess formed in a rear face of the holder and positioned at the forward fan venturi opening, which receive substantially all air flow from the forward venturi opening in the recess. A multiplicity of passages in the holder guide air received in the recess through the heating elements. Each passage extends between a forward face and the rear face of the holder, and each passage has a forward opening in the forward face of the holder and a rear opening in the recess, spaced forwardly of the forward fan venturi opening. Each passage is associated with a different one of the heating elements, the associated heating element being positioned intermediate of the forward and rear passage openings, and positioned so that all air flow in the passage is constrained to flow through the core.

The passage and the recess are shaped or dimensioned to provide a smooth air flow through the cores. In particular, each of the passages has a minimum cross-sectional area which corresponds substantially to the cross-sectional area of the associated heating element. Each passage is flared rearwardly and radially outwardly from the rear face of the associated heating element to guide air flows smoothly towards the heating element. The recess is similarly flared, radially outwardly and rearwardly, from about the rear passage openings to the rear face of the holder. The flaring which may be either convex or concave result in less turbulent air flows and consequently quieter operation.

Electrical connection means are provided which extend into the holder for placing the coatings of each heating element in contact with the source of electric power, and also serve to place the fan in contact with the source of power.

Other aspects and advantages of the present invention, particularly a novel heating element holder, will be apparent from the description below of a preferred embodiment.

DESCRIPTION OF THE DRAWINGS

The invention will be better understood with reference to drawings illustrating a preferred embodiment, in which.

DESCRIPTION OF PREFERRED EMBODIMENT

Figures 1, 2:
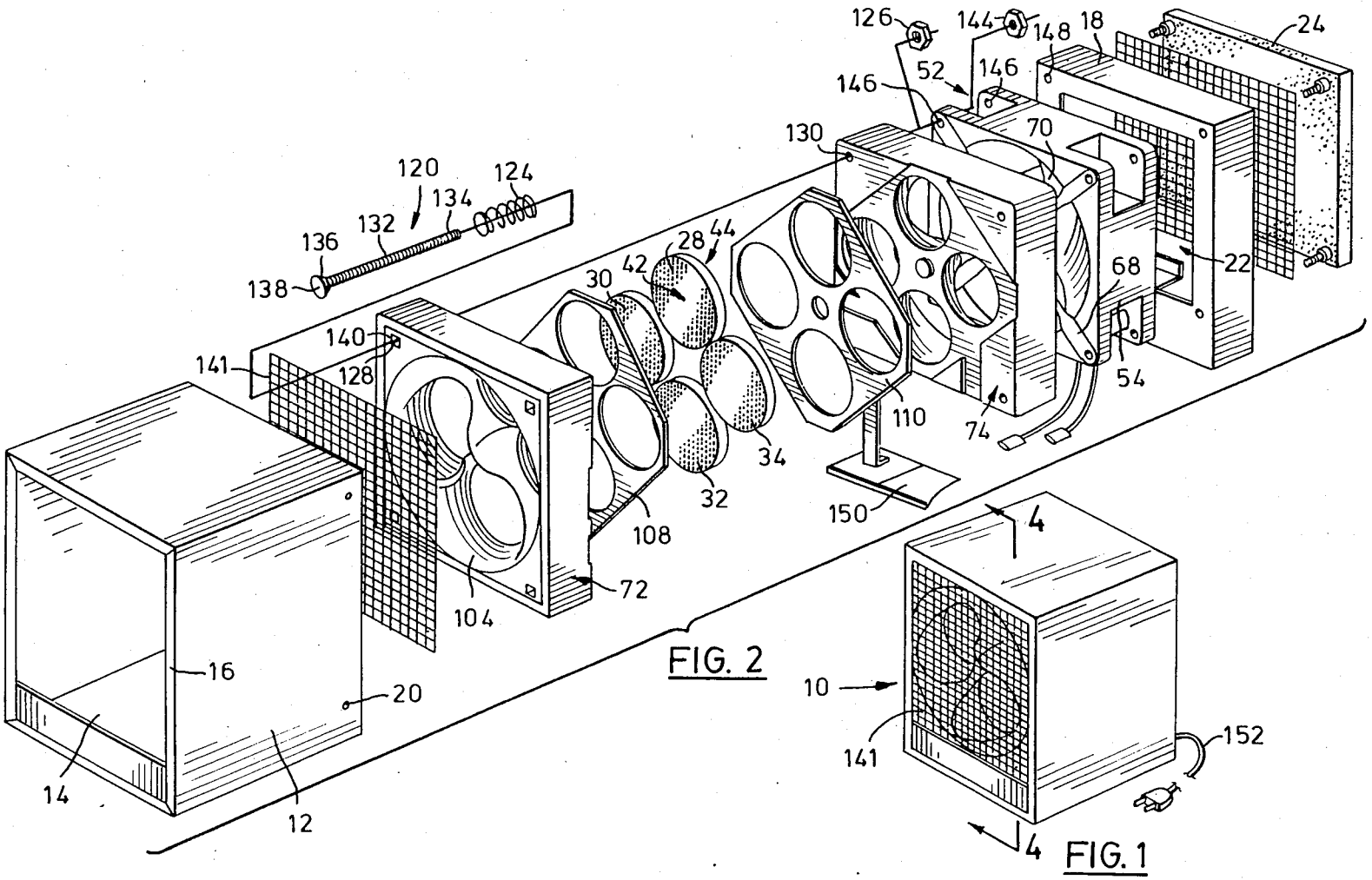
FIG. 1 is a perspective view of an electric heater embodying the invention.
FIG. 2 is an exploded perspective view of the heater.

FIGS. 1 and 2 illustrates the major components (excepting wiring) of an electric heater 10 embodying the invention. The heater 10 includes a housing constructed of sheet metal. The housing includes a main housing member 12 whose front face has a forward air outlet 14 circumscribed by abuttment flanges 16 (only one specifically indicated in FIG. 2). The housing also includes a rear housing insert 18 which fits tightly into the back of the main housing member 12 and which is attached to the main housing member 12 by means of screws (not illustrated) threaded through holes (only one hole 20 specifically indicated) provided in the sidewalls of the main housing member 12. The rear housing insert 18 has a rear air inlet 22 which is normally covered by a removable sheet 24 of appropriate air filtering material, retained by means of brackets 26 (two such brackets being illustrated in the cross-sectional view of FIG. 4). The construction, function and assembly of many of the components will be readily apparent, and consequently only details of the various components relating specifically to aspects of the invention will be provided in order to better highlight the invention.

The heating function of the electric heater 10 is provided by four disk-shaped heating elements 28, 30, 32, 34. The heating elements are substantially identical, and consequently only the heating element 28 will be described in detail, with particular reference to FIG. 5 where components of the heating element 28 better illustrated. The heating element 28 includes a planar core 40 of semiconductor material having a forward face 42, and an opposing rear face 44. The thickness of the core 40 is about ¼ inch, and the diameter of the core 40 is about 1 and 15/16 inches. Conductive silver coatings 48, 50 are deposited on the forward and rear core faces 42, 44, and serve to produce a distributed current flow between the opposing core faces 42, 44 when a voltage difference is applied to the coatings 48, 50. A multiplicity of apertures (not specifically indicated) extending between the forward and rear core faces 42, 44 permit air flow through the core 40 to draw heat from the core 40 during operation. The relative orientation of the cores is that illustrated in FIG. 2, namely, a generally coplanar, spaced-apart relationship.

The semiconductor material of the cores is preferrably a mixture of lead titanate and barium titanate, although a variety of other semiconductor materials may be used. The semiconductor material has a relatively high positive resistance-temperature coefficient (PTC), which is normally about 7.65 ohms/degrees centigrade (as measured between the opposing faces of all cores and considering the cores as parallel resistances). The resistance as measured between the opposing faces of the cores (once again considering the cores to be resistances connected in parallel) totals about 8 ohms at 165 degrees centigrade and about 161 ohms at 185 degrees centigrade. With a line voltage of 110 v. RMS applied to the opposing faces of the cores, the cores will have a nominal power consumption of about 1,500 W at an operating temperature of 165 degrees centigrade, and a nominal power consumption of 75 W at an operating temperature of 185 degrees centigrade. It will be readily apparent that the power consumption of the cores drops markedly as the operating temperature of the cores rises. Accordingly, in most circumstances, with no air flow through the cores to draw heat, the cores may be expected to reach an equilibrium temperature below about 200 degrees centigrade.

A fan 52 is mounted inside the main housing member 12 intermediate of the rear inlet 22 and the forward air outlet 14. The fan 52 has a fan casing 54 which defins a fan venturi 56. The fan venturi 56 has a forward venturi opening 58, a rear venturi opening 60 and a central longitudinal axis 62. The fan 52 has a central hub 64 mounted in the fan venturi 56 in general alignment with the venturi axis 62 by means of a spider 66 which has four legs 68 (only one specifically indicated) connecting the hub 64 to the fan casing 54. The hub 64 contains an electric motor (not illustrated) and a fan blade assembly 70 which can be rotated by the motor to produce an air flow forwardly through the fan venturi 56. Power to operate the motor is conducted through one of the legs of the spider 66, in a manner which will not be described. A suitable fan is sold by Rotron Inc. of Woodstock, N.Y., U.S.A. under the trademark MUFFIN.

The heater 10 also includes a heating element holder which holds the heating elements 28, 30, 32, 34 in the generally coplanar, spaced-apart relationship referred to above. The heating element holder also orients the cores of the heating elements generally perpendicular to the longitudinal axis 62 of the fan venturi 56, spaced about 1 inch forwardly of the forward venturi opening 58 with each rear core face facing towards the forward venturi opening 58. The holder has a two-piece separable construction involving a forward holder member 72 and a rear holder member 74, each of which is formed of a ceramic material. The term "ceramic material" as used in this specification is intended to denote a clay-like material such as fired greenware, porcelain or any other material that can be molded in an initial condition and then fired to produce a hard durable product and that is both thermally and electrically insulating. Such ceramic materials are generally inexpensive and easily molded into the shapes required. It will be appreciated, however, that the resultant product tends to be very brittle.

The forward holder member 72 defines a forward face 76 of the holder and has an opposing inner face 78. The rear holder member 74 defines a rear face 80 of the holder and has an opposing inner face 82 which is positioned adjacent the inner face 78 when the heating element holder is fully assembled.

Figure 3:
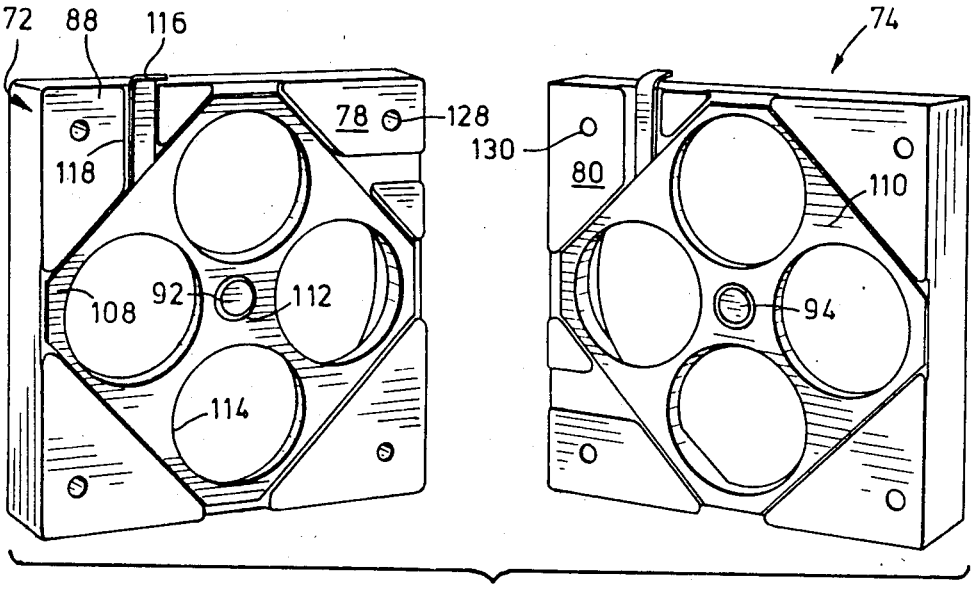
FIG. 3 is a perspective view of a heating element holder incorporated in the heater.
Figure 4:
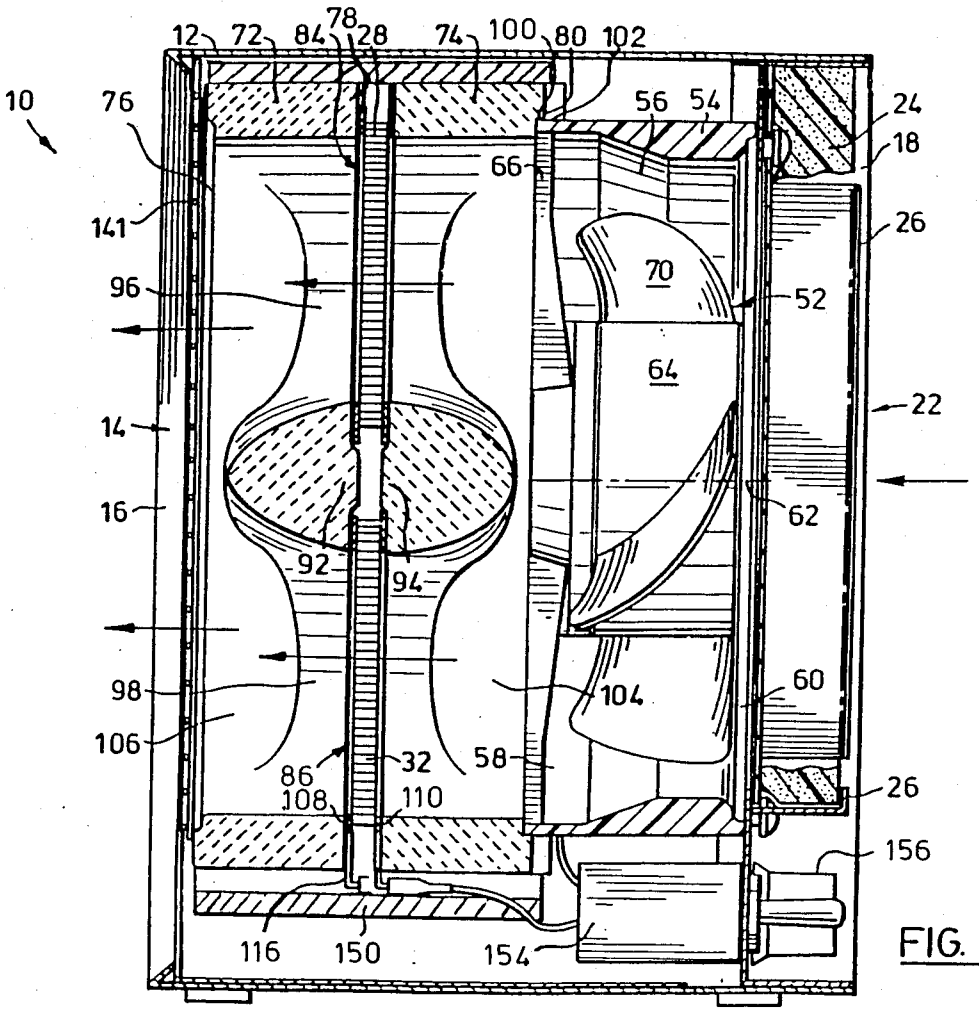
FIG. 4 is a cross-sectional view along the lines 4-4 of FIG. 1.

The inner holder member faces 78, 82 are contoured to define pockets (two specifically indicated by reference numerals 84, 86 in the cross-sectional view of FIG. 4) in which the heating elements are retained. The contouring in this instance consists of generally triangular projections (only two projections 88, 90 specifically indicated in FIG. 3 where the contouring is best shown) and central circular projections 92, 94 best illustrated in the view of FIG. 3 where the holder members 72, 74 are shown separated. When the holder is assembled, as in FIG. 4, the pockets closely receive the heating elements, gripping the opposing faces of each heater element core. Although the pockets defined are relatively loose (in radial directions), the arrangement has proven sufficient for the purposes of the invention.

The heating element holder also has four passages, one associated with a different one of the four heating elements, which direct air flows through the heating elements. Each passage extends between the forward and rear holder faces 76, 80, and has a forward passage opening (not specifically indicated) in the forward holder face 76 and a rear passage opening (not specifically indicated) in the rear holder face 80, more specifically, in a recess formed in the rear holder face 80 and described more fully below. Two such passages 96, 98 are specifically indicated in the cross-sectional view of FIG. 4. It will be apparent from FIG. 4 that each of the passages 96, 98 intersects the pocket in which the associated heating element 28 or 32, respectively, is contained, and that each of the passages 96, 98 has a minimum cross-sectional area perpendicular to the venturi axis 62 which is substantially the same as the cross-sectional area of the associated heating element, thereby ensuring retention of the associated heating element without significantly impeding air flow through the associated heating element. The heating elements are of course so positioned in the associated passages that substantially all air flow in the passages is constrained to flow through the cores of the heating elements.

The holder is also adapted to receive substantially all air flow from the forward venturi opening 58. In particular, the rear holder member 74 has a rectangular circumferential lip 100 dimensioned to fit about a corresponding lip 102 of the fan casing 54. Air flow from the forward venturi opening 58 is consequently directed against the rear holder face 80, and a large recess 104 is formed in the rear holder face 80 adjacent to and in general axial alignment with the forward venturi opening 58, to receive the air flows. Each of the passages (such as the passages 96, 98) in which the heating elements are positioned has its rear passage opening located within the recess 104, spaced forwardly of the forward venturi opening 58. As will be apparent in FIG. 4, where the cross-sectional shape of the passages 96, 98 is shown, the passages 96, 98 flare radially outwardly and rearwardly from the rear face of each associated heating element 28, 32 respectively to the associated rear passage opening. Similarly, the recess 104 flares radially outwardly and rearwardly from about the rear passage openings to the rear holder face 80. Accordingly, substantially all air escaping from the forward venturi opening 58 is delivered in a relatively smooth fashion to the heating elements.

The forward holder member 72 is identical to the rear holder member 74, and is effectvely the rear holder member 74 rotated through 180 degrees about a vertical axis. Accordingly, the forward holder member 72 defines a large recess 106 in the forward holder face 76 into which each of the forward passage openings opens. Accordingly, each of the holder passages such as the passages 96, 98 which are exemplary and illustrated in FIG. 4) flares radially outwardly and forwardly from the front faces of each associated heating element, and the recess 106 flares radially outwardly and forwardly from about the forward passage openings to the forward holder face 76. This arrangement produces a smoothing of the heated air flows escaping from the forward air outlet 14, but is not strictly essential to obtaining improved heat transfer efficiency and quieter operation. The arrangement does, however, eliminate the need for an additional distinct component in the heater 10.

Forward and rear conductive metal plates 108, 110 provide electrical contact with the forward and rear faces of the heating element cores inside the holder. It will be apparent from the view of FIG. 3 that the forward conductive plate 108 seats in a recess defined by the triangular projections on the inner face 78, and has a central aperture 112 which permits clearance of the central projection 92. The plate 108 overlays the forward faces of the heating element cores to provide the required electrical contact. Four apertures 114 (only one specifically indicated) with a circular periphery are formed in the plate 108, and are positioned over the forward faces of the heater element cores to permit passage of air. The diameter of the apertures 114 on the plate 108 is marginaly smaller than that of the heating elements to ensure electrical contact. A metal terminal strip 116 is spot welded to the plate 108, and extends to points external of the heater element holder, when assembled, to permit line voltage to be conveniently applied to the plate 108. To accommodate the terminal strip 116, a groove 118 is formed in the inner face 78 of the forward holder member 72, and is dimensioned to receive the terminal strip 116 loosely. The conductive plate 110 provides electrical contact with the rear faces of the heating element cores, and seats against the inner face 82 of the rear holder member, in a manner analogous to the seating of the plate 108. The structure and function of the two plates 108, 110 is substantially identical, and consequently no further detail will be provided regarding the plate 110.

The holder members 72, 74 are drawn together to contain the heating elements in the pockets by means of four fasteners. Since the fasteners are identical, only one fastener 120 has been specifically illustrated and indicated, in FIG. 2. The fastener 120 consists basically of a bolt 122, and coil spring 124 and a nut 126. The heating element holder is first loosely assembled, for example, by seating the plate 110 against the inner face 82 of the rear holder member 74, positioning the heater elements appropriately over the apertures in the plate 110, seating the plate 108 against the inner face 78 of the forward holder member 72, and then carefully bringing the holder member 72, 74 together in an operative orientation. The holder members 72, 74 then have four pairs of aligned apertures, only the apertures 128, 130 being specifically indicated, which extend fully between the forward and rear holder faces 76, 80. The coil spring 124 is located about the shaft 132 of the bolt 122, and the shaft extended fully through the aligned apertures 128, 130. The nut 126 is then threaded onto the rear shaft end portion 134 until the nut 126 abuts the rear holder face 80. The coil spring 124, which has a larger diameter than the apertures 128, 130, locates in the process about a forward shaft end portion 136, and acts between the bolt head and the forward holder face 76 to draw the holder members 72, 74 together. To ensure positive seating of the coil spring 124 against the forward holder member 72, a shallow well 140 is located about the aperture 128 in the forward holder face 76 and dimensioned to receive a portion of the coil spring 124. In the preferred embodiment illustrated, a metal grill 141 is interposed between the bolt head of each fastener and the associated coil spring to fasten the grill directly to the forward holder member 72, but the grill 141 could equally well be attached to the abutment flanges 16 of the main housing member 12.

The four fasteners being spring-loaded permit separation of the holder members 72, 74 in response to thermal expansion of the heating elements. This arrangement is critical, as the ceramic holder members 72, 74 are very brittle, and could otherwise be easily cracked during operation of the heater 10.

The heating element holder and grill 141 when assembled togeher are then attached to the fan casing 54. This attachment is effected by passing the rear shaft portions of the various fasteners through apertures in the fan casing 54 and attaching additional nuts to the rear shaft end portions. For example, with the fastener 120 illustrated, an aperture 142 in the fan casing 54 is aligned with the previously aligned holder member apertures 128, 130 and the rear shaft end portion 134 passed through the aperture 142. A nut 144 is then threaded onto the rear shaft end portion 134 to complete connection to the fan casing 54. The fan casing is in turn attached to the rear housing insert 18 by means of screws which are threaded through aligned apertures (only one pair of aligned apertures 146, 148 specifically indicated) in the fan casing 54 and rear housing insert 18. A strip of insulating material 150 (fragmented) is wrapped around the periphery of the heating element holder, and the entire assembly so formed is inserted into the main housing member 12 until the grill 141 engages the abutment flanges 16. Securement is completed by threading screws through the holes 20 in the main housing member 12 to secure the rear housing insert 18 to the main housing member 12, as mentioned above.

Figure 5:
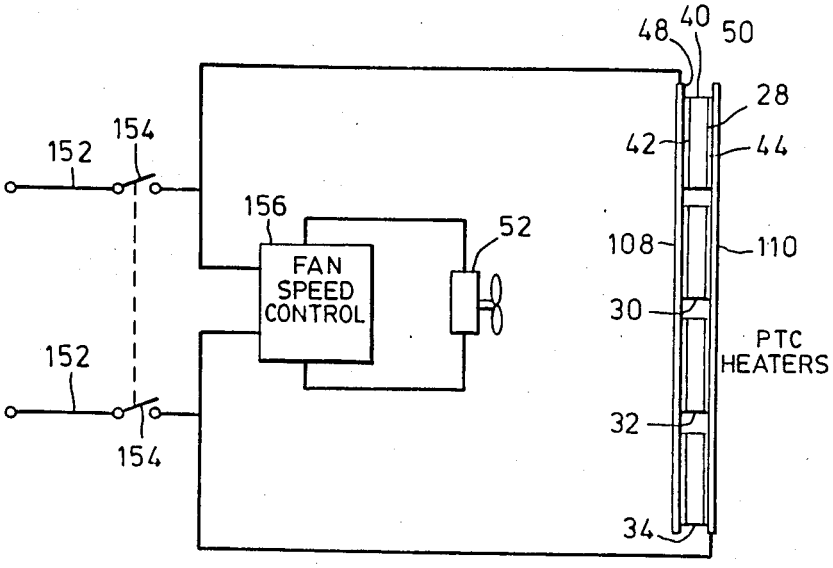
FIG. 5 is a schematic drawing of the electrical control circuitry associated with the heater.

The electrical wiring and control circuitry associated with the heater 10 is schematically illustrated in FIG. 5. Line power is delivered via a power cord 152 (the two lines of the power cord being indicated with the same reference numeral 152) to the conductive plates 108, 110. The electrical connection so formed is direct, involving no switching circuitry to control the amount of power delivered, except for a simple double pole single throw switch 154 which serves to turn the power to the heater 10 off and on. The power consumed by the heating elements, and the heat consequently delivered is controlled entirely by varying fan speed with a fan control 156. The fan control 156 includes as a primary switching element a bidirectional silicon controlled rectifier which permits substantially continuous variation of fan speed. By increasing fan speed the temperature of the heating elements drops, but the resultant increase in conductivity of the heating element cores results in a marked increase in power consumption. Thus, without effectively upwardly or downwardly scaling the line voltage applied to the heating element cores, the quantity of heat delivered can be varied. The required control circuitry and switches can be conveniently mounted to the rear housing insert 18 with appropriate wiring, as schematically illustrated, conducting power to the fan 52 and heating elements. These matters will be readily apparent to one skilled in the art.

A test was performed to determine whether a heater substantially identical to the preferred embodiment 10 exhibited improved heat transfer efficiency and quieter operation. The test involved a comparison with a prototype device that had an identical housing, identical heating elements, an identical fan, and identical control circuitry. The principal difference between the preliminary prototype and the preferred version of the heater resided in the heating element holder. The four heating elements were contained between two metal plates, bolted together, each of which was apertured to permit passage of air through the heating elements in a manner similar to that of the conductive plates 108, 110. The assembly so formed was bolted to the associated fan with the heating elements positioned at about 1 inch from the forward fan venturi opening. Power consumption of the cores was monitored by means of a watt meter. With the prototype version coupled to a 110 v. RMS line source, an ambient temperature of about 25 degrees centigrade, and the fan operating at full speed, the heating elements had a total power consumption of about 1,200 W. A noticeable leakage of air backscattered through the rear fan venturi opening was also noted. The preferred version substantially identical to the preferred embodiment 10 was operated under similar conditions, and a heating element power consumption of about 1,380 W was noted with no apparent leakage of air through the rear fan venturi opening. This represents about a 15% improvement in energy transfer to fan air flows. Additionally, on a purely qualitative basis, it was noted that the preferred version was considerably quieter in operation.

It will be appreciated that a preferred embodiment of the invention has been described and that modifications may be made therein without departing from the spirit of the invention and the scope of the appended claims.

I claim:

1. An electric heating unit, comprising:

a plate-shaped heating element having a core of semiconductor material with a positive resistance-temperature coefficient, the core having a pair of opposing core faces including a first core face and a second core face and a multiplicity of apertures extending between the first and second core faces whereby air can flow through the core, the heating element having a first conductive coating over the first core face and a second conductive coating over the second core face;

a heating element holder formed of an electrically and thermally insulating material, the heating element holder including first and second separable holder members, the first holder member overlaying the first core face and the second holder member overlaying the second core face, the first and second holder members being apertured adjacent the first and second core faces respectively to define a passage through the heating element holder permitting air flow through the core;

electrical contact means for electrically contacting the heating element, including coating contact means between the first and second holder members for separately contacting each of the first and second conductive coatings, and including terminal means accessible exernally of the heating element holder and connected to the coating contact means for defining a first terminal electrically connected to the first conductive coating and a second terminal electrically connected to the second conductive coating and electrically isolated from the first terminal; and, attachment means for drawing together the first and second holder members, the attachment means including biasing means for urging the first and second holder members towards one another in elastically displaceable relative relationshsip so that the heating element is secured between the holder members in contact with the contact means.

2. An electric heating unit as claimed in claim 1 in which:

the first holder member has a first holder face internal to the heating element holder;

the second holder member has a second holder face internal to the heating element holder;

the first and second holder faces are contoured together to define a pocket containing the heating element.

3. An electric heater unit as claimed in claim 2 in which the coating contact means comprise a pair of conductive metal plates located between the first and second holder faces and shaped to seat against the first and second holder faces, the pair of conductive metal plates including a first metal plate overlaying the first conductive coating and a second metal plate overlaying the second conductive coating, the first and second metal plates being apertured to permit passage of air through the apertures of the core of the heating element.

4. An electric heating unit as claimed in claim 3 in which the first and second holder members are formed of a ceramic material.

5. An electric heating unit as claimed in claim 1 in which the first and second holder members have a multiplicity of pairs of aligned apertures, one aperture of each a pair of aligned apertures being formed in the first holder member and the other aperture of each pair of aligned apertures being formed in the second holder member, and in which the attachment means comprise:

a multiplicity of fasteners, one fastener associated with each of the pairs of aligned apertures;

each fastener having a shaft extending through the associated pair of aligned apertures with a first shaft end portion extending externally of the first holder member and a second shaft end portion extending externally of the second holder member, a first abuttment member attached to the first shaft end portion, a second abuttment member attached to the second shaft end portion and bearing against the second holder member, and coil spring means acting between the first abuttment member and the first holder member for urging the first holder member against the second holder member.

6. An electric heating unit as claimed in claim 5 in which the first and second holder members are formed of a ceramic material.

7. An electric heating unit, comprising:

a multiplicity of plate-shaped heating elements in generally coplanar spaced-apart relationship, each heating element having a core of semiconductor material with a positive resistance-temperature coefficient, the core having a pair of opposing core faces including a first core face and a second core face and a multiplicity of apertures extending between the first and second core faces whereby air can flow through the core, each heating element having a first conductive coating over the respective first core face and a second conductive coating over the respective second core face;

a heating element holder formed of an electrically and thermally insulating material, the heating element holder including first and second separable holder members, the first holder member overlaying the first core faces of the heating elements and the second holder member overlaying the second core faces of the heating elements, the first and second holder members being apertured adjacent the first and second core faces to define passages through the heating element holder permitting air flow through the cores;

electrical contact means for electrically contacting the heating elements, including coating contact means between the first and second holder members for separately contacting the first conductive coatings and the second conductive coatings, and including terminal means accessible externally of the heating element holder and connected to the coating contact means for defining a first terminal electrically connected to the first conductive coatings and a second terminal electrically connected to the second conductive coatings and electrically isolated from the first terminal; and, attachment means for drawing together the first and second holder members, the attachment means including biasing means for urging the first and second holder members towards one another in elastically displaceable relative relationship so that the heating elements are secured between the holder members in contact with the contact means.

8. An electric heating unit as claimed in claim 7 in which:

the first holder member has a first holder face internal to the heating element holder;

the second holder member has a second holder face internal to the heating element holder;

the first and second holder faces are contoured together to define a multiplicity of pockets each containing one of the heating elements.

9. An electric heater unit as claimed in claim 8 in which the coating contact means comprise a pair of conductive metal plates located between the first and second holder faces and shaped to seat against the first and second holder faces, the pair of conductive metal plates including a first metal plate overlaying the first conductive coatings and a second metal plate overlaying the second conductive coatings, the first and second metal plates being apertured to permit passage of air through the apertures of the cores of the heating elements.

10. An electric heating unit as claimed in claim 9 in which the first and second holder members are formed of a ceramic material.

11. An electric heating unit as claimed in claim 7 in which the first and second holder members have a multiplicity of pairs of aligned apertures, one aperture of each a pair of aligned apertures being formed in the first holder member and the other aperture of each pair of aligned apertures being formed in the second holder member, and in which the attachment means comprise:

a multiplicity of fasteners, one fastener associated with each of the pairs of aligned apertures;

each fastener having a shaft extending through the associated pair of aligned apertures with a first shaft end portion extending externally of the first holder member and a second shaft end portion extending externally of the second holder member, a first abuttment member attached to the first shaft end portion, a second abuttment member attached to the second shaft end portion and bearing against the second holder member, and coil spring means acting between the first abuttment member and the first holder member for urging the first holder member against the second holder member.

12. An electric heating unit as claimed in claim 11 in which the first and second holder members are formed of a ceramic material.

13. An electric heater comprising:

a housing having a rear air inlet and a forward air inlet;

a fan mounted inside the housing for producing an air flow forwardly from the rear air inlet to the forward air outlet, the fan having a fan venturi for directing the air flow including a forward venturi opening, a rear venturi opening and a longitudinal venturi axis;

a multiplicity of plate-shaped heating elements each having a core of semiconductor material with a positive resistance-temperature coefficient, each core having a pair of opposing core faces including a forward core face and a rear core face and a multiplicity of apertures extending between the forward and rear core faces whereby air can flow through the cores, each heating element having a forward conductive coating over its forward core face and a rear conductive coating over its rear core face;

a heating element holder mounted in the housing intermediate of the forward venturi opening and the forward air outlet and having forward and rear holder faces, the heating element holder including holding means for holding the heating elements in generally coplanar, spaced-apart relationship and for orienting each of the cores generally perpendicular to the longitudinal venturi axis and spaced forwardly of the forward venturi opening, the rear holder face having a recess positioned over the forward venturi opening to receive substantially all air flow from the forward venturi opening, the holder having a multiplicity of passages each having a forward passage opening in the front face of the heating element holder and a rear passage opening in the recess spaced forwardly of the forward venturi opening, each passage having an associated one of the heating elements positioned intermediate of its forward and rear passage openings and so oriented that all air flow in the passage flows through the associated heating element, each passage flaring radially outwardly and rearwardly from the rear core face of the associated heating element to its rear passage opening, the recess flaring radially outwardly and rearwardly from about the rear passage openings to the rear face of the heating element holder; and, electrical contact means extending into the heater element holder for use in placing the forward and rear conductive coatings of the heating element cores and the fan in contact with a source of electric power.

14. An electric heater as claimed in claim 13 in which:

the heating element holder includes forward and rear separable holder members, the forward holder member overlaying the forward core faces and the rear holder member overlaying the rear core faces;

the electrical contact means include coating contact means between the forward and rear holder members for separately contacting each of the forward and rear conductive coatings, and including terminal means accessible externally of the heating element holder and connected to the coating contact means for defining a first terminal electrically connected to the forward conductive coatings and a second terminal electrically connected to the rear conductive coatings and electrically isolated from the first terminal; and, attachment means for drawing the forward and rear holder members together in elastically displaceable relative relationship whereby the heating elements are secured in the heating element holder and the forward and rear holder members are separable with expansion of the heating elements.

15. An electric heater as claimed in claim 14 in which:

the forward holder member has a face internal to the heating element holder;

the rear holder member has a face internal to the heating element holder;

the internal faces of the holder members are contoured together to define a multiplicity of pockets, each pocket containing one of the heating elements.

16. An electric heater as claimed in claim 15 in which the coating contact means comprise a pair of conductive metal plates located between the forward and rear holder members and shaped to seat against the internal faces of the forward and rear holder members, the pair of conductive metal plates including a forward metal plate overlaying the forward conductive coatings and a rear metal plate overlaying the rear conductive coatings, the forward and rear metal plates being apertured to permit passage of air through the apertures of the cores of the heating elements.

17. An electric heater as claimed in claim 16 in which the forward and rear holder members have a multiplicity of pairs of aligned apertures, one aperture of each pair of aligned apertures being formed in the forward holder member and the other aperture of each pair of aligned apertures being formed in the rear holder member, and in which the attachment means comprise:

a multiplicity of fasteners, one fastener associated with each of the pairs of aligned apertures;

each fastener having a shaft extending through the associated pair of aligned apertures with a forward shaft end portion extending externally of the forward holder member and a rear shaft end portion extending externally of the rear holder member, a forward abuttment member attached to the forward shaft end portion, a rear abuttment member attached to the rear shaft end portion, and coil spring means acting between one of the forward and rear abuttment members and a corresponding one of the forward and rear holder members for urging the holder member together.

18. An electric heater as claimed in claim 17 in which the forward and rear holder members are formed of a ceramic material.

* * * * *